United States Patent [19]

Weiperth et al.

[11] 4,371,114

[45] Feb. 1, 1983

[54] SPRAYING GUN

[75] Inventors: Vilmos Weiperth; Tibor Lezsák, both of Budapest, Hungary

[73] Assignee: Chemokomplex Vegyipari Gépés Berendezés Export Import Vallalat, Budapest, Hungary

[21] Appl. No.: 182,985

[22] Filed: Sep. 2, 1980

Related U.S. Application Data

[63] Continuation-in-part of Ser. No. 101,189, Dec. 7, 1979, abandoned, which is a continuation of Ser. No. 954,458, Oct. 25, 1978, abandoned, which is a continuation of Ser. No. 702,842, Jul. 6, 1976, abandoned.

[51] Int. Cl.[3] ..... A62C 13/40

[52] U.S. Cl. ..... 239/309; 239/323; 239/328; 222/386.5; 222/389

[58] Field of Search ..... 239/308, 309, 323, 328, 239/82, 302; 222/386.5, 389

[56] References Cited

FOREIGN PATENT DOCUMENTS 202156 8/1923 United Kingdom ..... 222/389

1207677 10/1970 United Kingdom ..... 222/389

*Primary Examiner*—Richard A. Schacher

*Attorney, Agent, or Firm*—Gabriel P. Katona

[57] ABSTRACT

A spraying gun for atomizing, i.e. spraying substances in the liquid state having a closure head for cartridges filled with a compressed gas, and a gun head including a liquid atomizer, a regulating valve and members for operating the valve, the gun having a tubular body formed as a container, which is divided into a gas space and a liquid space by a freely movable member which may be a piston, an elastic spherical member that is filled with a gas under overpressure, or a foil pouch closed at both ends. Various optional features are also disclosed.

5 Claims, 5 Drawing Figures

SPRAYING GUN

RELATED APPLICATIONS

This application is a continuation-in-part of our U.S. patent application Ser. No. 101,189 filed Dec. 7, 1979, now abandoned which is a continuation of U.S. patent application Ser. No. 954,458 filed Oct. 25, 1978, now abandoned, which is a continuation of U.S. patent application Ser. No. 702,842 filed July 6, 1976, now abandoned.

BACKGROUND OF THE INVENTION

This invention relates to a spraying gun for atomizing, i.e. pulverizing or spraying substances in the liquid state, provided with a closure head for cartridges, as well as a gun head including a pulverizer, a regulating valve and members for operating the valve. With the spraying gun according to the invention, paints, lacquers, spray solutions and other materials can be atomized and sprayed onto various objects.

Social and economic developments cause people to increasingly do their own repairing of their personal possessions and living quarters as they require repairs, and/or to maintain them themselves. Such repair and maintenance jobs include for example the painting of apartments, week-end homes and doors or windows, anti-corrosion protection of metal objects, painting and polishing of furniture, repairing damaged sprayed enamels of vehicles, plant and tree spraying, etc.

The performance of such jobs is hampered since the hobbyist or do-it-yourselfer does not have at hand a spraying gun which is useful for all purposes, is cheap and operates safely and simply.

The earliest devices in the particular field of this invention were the pneumatic spraying guns. In these, the liquid to be atomized is forced through the atomizer together with an atomizing medium in the gas state, preferably, air. The disadvantage of pneumatic spraying guns resides in that, on the one hand, a high-pressure atomizing medium has to be used and major portion of the applied pressure energy is not exploited. On the other hand, the atomizing medium entrains and scatters a substantial portion of the atomized substance when impinging upon the surface being coated. As a result, these known devices are rather energy-demanding, on the one hand, and on the other, they operate with large material losses, Pneumatic spraying guns cannot be considered for hobbyists' or do-it-yourself projects.

To eliminate the above disadvantages, the so-called airless spraying has been developed in which the liquid to be atomized and sprayed is forced through the atomizer by itself. The liquid to be atomized is brought to the atomizer by the aid of pressure produced within the gas space of the supply container, or by means of a pump.

Industrial devices usually pulverize or atomize at a pressure of 70–250 att (atmospheric over-pressure, i.e. pressure in excess of atmospheric pressure) with performances of 2000–4500 $cm^3$/minute by the aid of screw- or gear-type pumps. The supply container is designed as a large-size, stationary apparatus. The atomizers of the spraying guns are usually so-called planar pulverizers, plan-spray and/or flat-nozzle systens. It follows clearly from the above that these are not suitable for the hobbyist or do-it-yourselfer.

The devices that could be considered for do-it-yourself or hobbyists' purposes work at 30–35 att with performances of 100–130 $cm^3$/min. The Mistral-type devices which are most widely used, bring the liquid to be atomized to the atomizer by a piston that freely swings in an electromagnetic field that is built into a so-called rising conduit. The atomizer is generally of a spinning-chamber design. The supply container is in turn mounted onto the spraying gun and the rising conduit is immersed into the liquid to be atomized.

The major disadvantages of the devices that have the supply containers mounted on the spraying guns are that the possible operational positions of the spraying guns depend on the containers. Namely, if the liquid to be atomized does not cover the mouth opening of the rising conduit as result of a change in position of the spraying guns, understandably the guns can not atomize. This situation arises during operation when spraying onto surfaces that are above head.

A further drawback of the known devices is that the spraying guns have a very complicated construction which increases their acquisition or purchase costs, while the amount of work needed for cleaning them subsequent to use is substantially increased. For the most part the rinsing with a solvent is not sufficient. The necessary degree of cleaning is possible only by completely disassembling the gun and by individually washing the component parts. In addition, the inner mechanisms of the known spraying guns are very sensitive during operation to the fineness of the substance to be atomized and often become clogged.

The Mistral-type spraying guns are particularly disadvantageous when the MOHS hardness of the paints that constitute the major part of the substances to be atomized is between the values of 9–9.5 so that the piston is ruined after a relatively short time.

It is finally a common drawback of all known spraying guns that they cannot be operated without a power source, such as an electric power line or a separate power unit.

The reliance of spraying guns on a power source was eliminated by the apparatus made according to the Hungarian Pat. No. 155,739 wherein the pressure energy of a compressed gas cartridge is used for liquid atomization. With this device, the gas pressure of the cartridge increases the inner pressure of the gas space within the supply container, and the liquid is forced through the atomizer by means of this excess pressure.

However, this device is also disadvantageous because of its dependence on the position of the supply container and its complicated construction. As a further drawback one can mention that the atomizing medium which contacts the liquid to be sprayed in the supply container is dissolved in the liquid as a function of the excess pressure, and the bubbles exiting to the atmosphere manifest a phenomenon as if the spraying gun is being operated with pneumatic atomizing and spraying.

BRIEF SUMMARY OF THE INVENTION

The object of the invention is to develop a cartridge-type atomizing or pulverizing and spraying gun which has a simple construction and is insensitive to the position of the supply container.

According to the invention this object is solved in that the inventive spraying gun has a tubular body formed as a container, and the latter is divided by a freely movable member into a gas space and liquid space that are gas- and liquid-tightly sealed from one another A further characteristic of the device according to the invention is that its freely movable member is a piston or a foil pouch that is free but closed at both ends, the pouch being filled with the substance to be atomized. There is a needle, having a bore therein installed on the side of a valve disc of a regulating valve, which faces the liquid space.

The piston is preferably in the form of a sphere having an elastic wall and is filled with a gas under excess pressure. The elastic wall has an outer diameter which is larger at atmospheric pressure than the inner diameter of the tubular body.

The mantle surface of the piston may have packing rings, preferably with a saw-tooth cross-section, which surface rests against the inner surface of the tubular body.

Threaded blind holes may be formed on the front surfaces of the piston, or the front face which is toward the gas space may have a removing element, preferably a wire, secured thereto. An annular groove that has an inwardly narrowing cross-section can be formed on the surface of the piston which faces the gas space.

In the inventive spraying gun the geometric axis of the atomizer may coincide with or may alternatively form an angle with the geometric axis of the tubular body.

BRIEF DESCRIPTION OF THE DRAWINGS

The invention will hereinafter be described in full particulars by reference to the drawings of two practical exemplary embodiments of the inventive spraying gun. In the drawings.

DETAILED DESCRIPTION OF THE INVENTION

Figure 1:
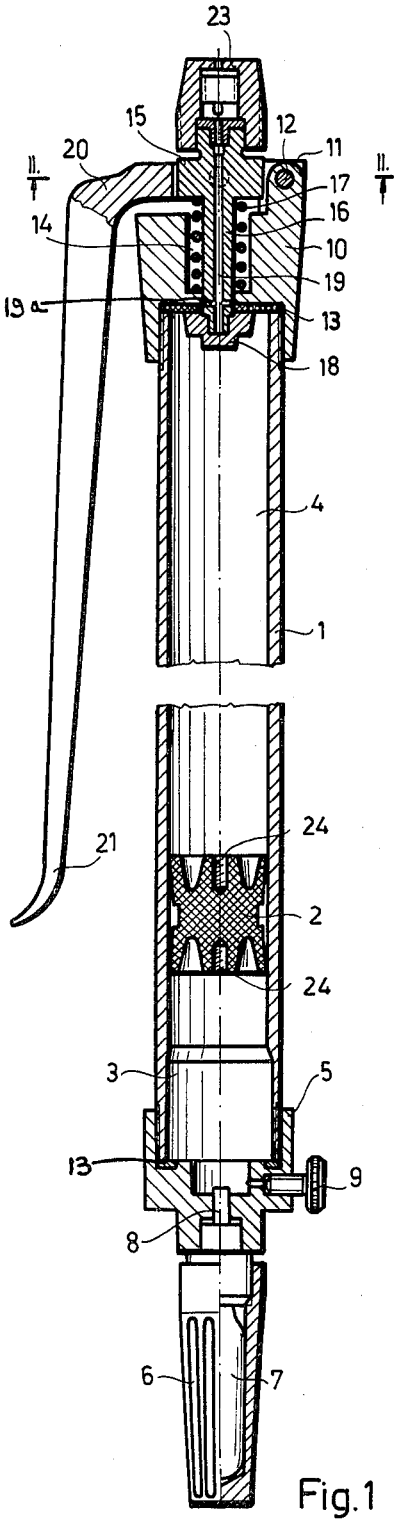
FIG. 1 is a longitudinal section of an exemplary inventive spraying gun.
Figure 2:
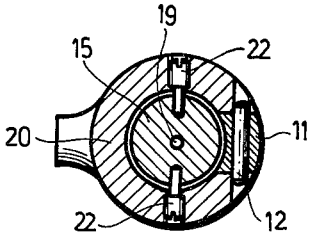
FIG. 2 is a cross-sectional view taken along line II—II of FIG. 1.

The spraying or atomizing gun according to the invention has in its exemplary embodiment shown in FIGS. 1 and 2 a tubular body 1 which is preferably metal. The constructional length of the tubular body 1 can be between 10 centimeters and 2 to 3 meters. Inside the body 1 there is a piston 2 which is preferably elastic. It moves along the longitudinal extent of the tubular body 1. The outer surface of the piston 2 contacts the inner surface of the tubular body 1 in a liquid- and gas-tight manner so that the piston 2 separates the inner space of the tubular body 1 into two spaces which change during operation, namely, a gas space 3 and a separate liquid space 4.

A closure head 5, preferably threaded, is secured to the end of the tubular body 1 on the side of the gas space 3. The other end of the closure head 5 has a cartridge holder 6, preferably threaded, attached thereto.

A cartridge 7 holding compressed gas is disposed in the cartridge holder 6. From the cartridge 7 the gas is led into the gas space 3 through a bore 8. A gas-release screw 9, preferably made in the form of a safety valve, is threaded into the closure head 5.

A gun head 10, preferably threaded, is secured to the end of the tubular body 1 on the side of the liquid space 4. The gun head 10 has an extension 11 with a pin 12 protruding to both sides. At a portion of the gun head 10 and of the closure head 5 toward the tubular body 1, a sealing disc 13 is fixed between the bottom of the depression that receives the end of the tubular body 1 and the front surfaces of the tubular body 1. The sealing disc 13 has a bore in the middle, the gun head 10 itself has a passage 14, through which a cylindrical bar extension 16 of a valve housing 15 is passed.

Along the bar 16, in the passage 14, between the bottom of the passage 14 and a larger diameter shoulder portion of the valve housing 15, there is disposed a coil spring 17 which tends to pull the rod 16 of the valve housing 15 out of the bore of the sealing disc 13. The rod 16 has a customary packing provided in the passage 14. At the end of the rod 16, on the side of the tubular body 1, a valve disc 18 is secured, and in the inoperative condition of the spraying gun the latter rests on the sealing disc 13 by the provision of the coil spring 17 and the rod 16. The bar portion 16 has a bore 19, explained in detail below.

At the end of the pin 12 in the extension 11 of the gun head 10 an operating member 20 is pivotably journaled. The member 20 surrounds the shoulder portion of the valve housing 15, in the form of a ring. In this arrangement, the operating member 20 has a long shaft or handle 21. The operating member 20 is connected to the valve housing 15 by means of pins 22.

An atomizer 23 is secured to the outer end of the valve housing 15. On the front surfaces of the piston 2 respective threaded blind bores are formed.

Figure 3:
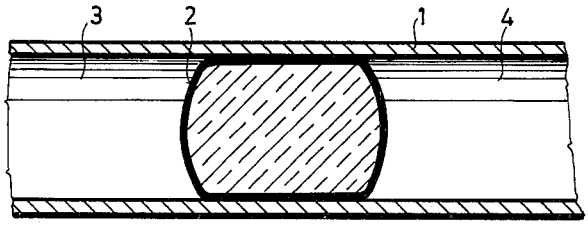
FIG. 3 is a cross-sectional view of an exemplary piston.

FIG. 3 shows a recommended exemplary form of the piston 2. The piston 2 is formed as a gas-filled sphere having an elastic wall, with an outer diameter that would be larger than the inner diameter of the tubular body 1 when removed therefrom into the outer atmosphere. During the operation of the spraying gun the shape of the piston 2 changes in accordance with the pressure that prevails in the gas space 3 and in the liquid space 4, but the piston always hugs the inner surface of the tubular body 1.

Figure 4:
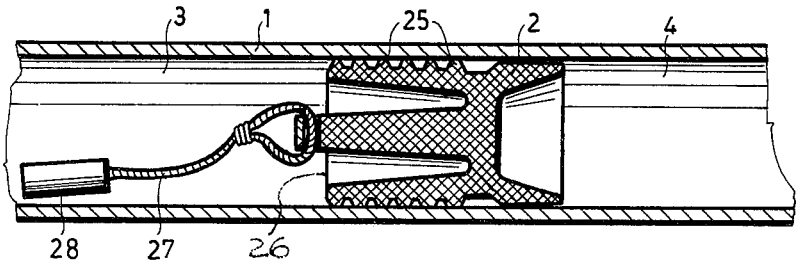
FIG. 4 is a cross-sectional view of another example of a piston of this invention.

FIG. 4 shows a further practical form of the piston 2. In this variant the mantle of the elastic piston 2, which touches the inner surface of the tubular body 1, is formed with packing rings 25 that have a saw-tooth cross section. In order to increase sealing forces, an annular groove 26 with an inwardly narrowing cross section is formed on the front surface of the piston 2 that faces the gas space 3.

A wire 27, having optionally a weight 28 attached to its outer end, may also be secured to this front surface for moving the pistion 2 and/or for removing the same from the tubular body 1.

Within the protective range afforded by this invention, the spraying gun can be constructed in a manner different from the embodiments specifically described.

Thus, for example, the inventive spraying gun may have its atomizer 23 axially aligned with the geometric axis of the tubular body 1, however, there can be a fixed or adjustable angle between these axes (not shown), as will be readily understood by those skilled in the art. The valve housing 15 may have for the latter purpose a liquid-tight ball- and - socket joint thereon for swiveling attachment of an adjustable atomizer, allowing spraying at various angles from the axial direction of the gun.

Figure 5:
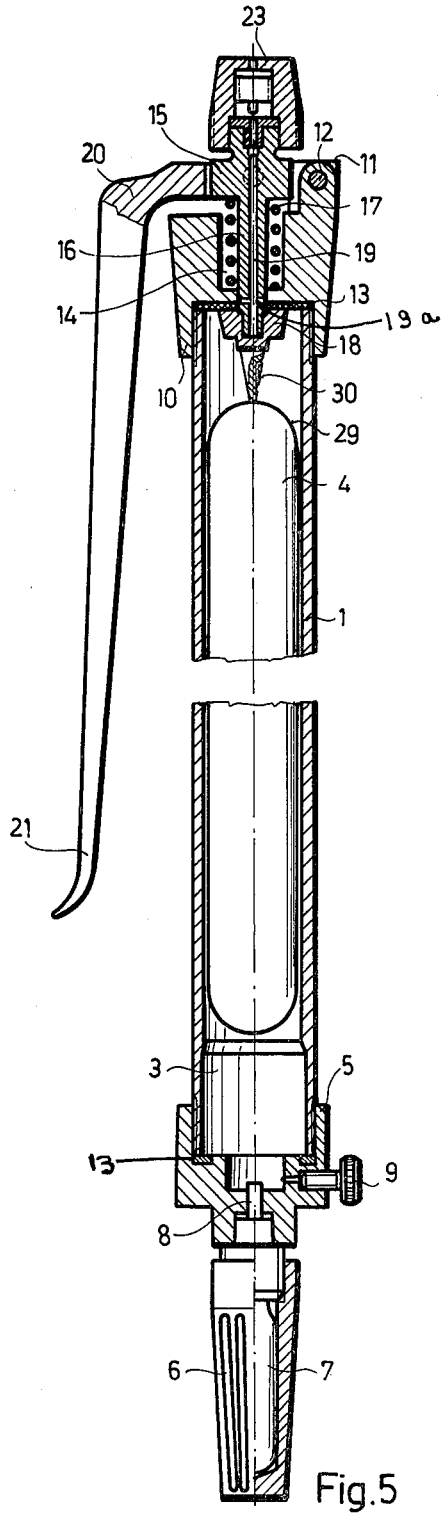
FIG. 5 is a longitudinal sectional view of a modified spraying gun of this invention.

The freely movable member of the spraying gun illustrated in FIG. 5 is a foil pouch 9, closed at both ends, which acts as a "pistion", and is filled with the liquid to be atomized, A needle 30 is installed on the side of the valve disc 18 that faces the liquid space 4 for piercing the foil pouch 29.

In the spraying guns that are fitted with the tubular bodies 1 of considerable constructional lengths, the operating menbers can be provided, for example, with control wires in lieu of the shafts or handles 21, to facilitate manipulation.

In the following the operation of the inventive spraying gun is described.

Before setting the spraying or atomizing gun to operate the closure head is removed from the tubular body 1 and the piston 2 is withdrawn from the tubular body 1.

With the embodiment according to FIG. 1, the piston 2 can be moved within the tubular body 1 by the aid of a rod (not shown) attached to the threaded blind bore 24 while the piston according to FIG. 3 can be pushed with a rod. The piston 2 of FIG. 4 can be moved by making use of the wire 27. Subsequently, a sufficient quantity of the liquid to be atomized is filled into the tubular body 1 whereupon the piston 2 is reinserted and the closure head 5 screwed on. A gas cartridge 7 is placed into the cartridge holder 6. The cartridge is pierced by turning the holder inward, thereby releasing the high-pressure gas from the cartrigde into the gas space 3.

During operation, the spraying gun is held at the tubular body so that the handle 21 is depressed at least by one finger. As a result of this depressing, the operating member 20 turns about the pin 12 and pushes down the valve housing 15 along the tubular body 1; via the pins 22, against the coil spring 17. Then the valve disc 18 moves away from the sealing disc 13, and liquid flows from the liquid space 4 of the tubular body 1 into the pulverizer 23 through lateral orifices 19*a* of bore 19 in the bar portion 16. By changing the depressing of the shaft 21, the liquid quantity that flows through the bore 19 can be regulated per unit of time.

After the atomizing or spraying is completed or terminated the handle 21 is released whereby the coil spring 17 presses the valve housing 15 back to its starting position so that the valve disc 18 again rests on the sealing disc 13, consequently shutting off the liquid space 4.

The more important characteristics of the inventive spraying or atomizing gun are as follows:

The structural arrangement is simple so that the gun can be easily and economically produced. The operation and cleaning do not require any particular skill or experience. It cannot get clogged during operation. No electricity source or power unit is needed for the operation. It is suitable for spraying of surfaces at any position relative to the operator. During atomization only liquid is discharged from the gun so that not much energy is required. It can be used without any danger even in areas containing explosive substances.

We claim:

1. A spraying gun for atomizing liquid substances, comrpising, in combination: an elongated tubular body having at one end thereof a compressed gas cartridge receiving closure head; and at the other end a gun head with an atomizer, a regulating valve, and means for operating said valve; a freely movable elastic partition member which divides said tubular body into a gas and liquid tight gas space and an adjoining, separate liquid and gas tight liquid space; threaded gas and liquid tight connections and sealing members between said tubular body, on the one hand, and each of said closure and said gun heads, on the other hand; a safety valve in said closure head which optionally releases the pressure from at least said gas space; wherein said partition member is in the form of a piston that has at least one front surface provided with a threaded blind bore for removably receiving a manipulating rod therein; wherein said operating means is intermediate along the geometric axis of the gun between said atomizer and said valve, and includes a laterally protruding, pivotable long handle that allows fine regulation of said valve when manually engaged at its free outer end; and wherein said tubular body, said liquid space, said gun head, said valve and said atomizer are substantially coaxial with the geometric axis allowing discharge of the liquid with a minimum of frictional resistance along its path.

2. The spraying gun as defined in claim 1, wherein said atomizer is at least partly swivelable to an angular position with respect to the axis of said tubular body.

3. A spraying gun for atomizing liquid substances, comprising, in combination: an elongated tubular body having at one end thereof a compressed gas cartridge receiving closure head; and at the other end a gun head with an atomizer, a regulating valve, and means for operating said valve; a freely removable elastic partition member which divides said tubular body into a gas and liquid tight gas space and an adjoining, separate liquid and gas tight liquid space; threaded gas and liquid tight connections and sealing members between said tubular body, on the one hand, and each of said closure and said gun heads, on the other hand; a safety valve in said closure head which optionally releases the pressure from at least said gas space; wherein said partition member is in the form of a piston wherein said piston is a sphere with an elastic wall the outer diameter of which, when said sphere is filled with gas under pressure is larger at atmospheric pressure than the inner diameter of said tubular body; wherein said operating means is intermediate along the geometric axis of the gun between said atomizer and said valve, and includes a laterally protruding, pivotable long handle that allows fine regulation of said valve when manually engaged at its free outer end; and wherein said tubular body, said liquid space, said gun head, said valve and said atomizer are substantially coaxial with the geometric axis allowing discharge of the liquid with a minimum of frictional resistance along its path.

4. A spraying gun for atomizing liquid substances, comprising, in combination: an elongated tubular body having at one end thereof a compressed gas cartridge receiving closure head; and at the other end a gun head with an atomizer, a regulating valve, and means for operating said valve; a freely movable elastic partition member which divides said tubular body into a gas and liquid tight gas space and an adjoining, separate liquid and gas tight liquid space; threaded gas and liquid tight connections and sealing members between said tubular body, on the one hand, and each of said closure and said gun heads, on the other hand; a safety valve in said closure head which optionally releases the pressure from at least said gas space; wherein said partition member is in the form of a piston that is in the form of a foil pouch closed at both ends, said regulating valve having therein a valve disc, and a hollow needle secured to the side of said valve disc which faces said liquid space for piercing said pouch to allow filling with the substance to be atomized; wherein said operating means is intermediate along the geometric axis of the gun between said atomizer and said valve, and includes a laterally protruding, pivotable long handle that allows fine regulation of said valve when manually engaged at its free outer end; and wherein said tubular body, said liquid space, said gun head, said valve and said atomizer are substantially coaxial with the geometric axis allowing discharge of the liquid with a minimum of frictional resistance along its path.

5. The spraying gun as defined in claim 4, wherein said atomizer is at least partly swivelable to an angular position with respect to the axis of said tubular body.

* * * * *